US006109875A

United States Patent [19]

Gross

[11] Patent Number: 6,109,875

[45] Date of Patent: Aug. 29, 2000

[54] CYCLOIDAL PROPELLER

[75] Inventor: Harald Gross, Bolheim, Germany

[73] Assignee: Voith Hydro GmbH & Co., KG, Heidenheim, Germany

[21] Appl. No.: 09/266,467

[22] Filed: Mar. 11, 1999

[30] Foreign Application Priority Data

Mar. 14, 1998 [DE] Germany ..... 198 11 251

[51] Int. Cl.[7] ..... B63H 3/00

[52] U.S. Cl. ..... 416/111; 416/110; 416/108; 416/109; 416/159; 416/162

[58] Field of Search ..... 416/110, 111, 416/112, 108, 109, 159, 162

[56] References Cited

U.S. PATENT DOCUMENTS

| | | | |
|---|---|---|---|
| 3,716,014 | 2/1973 | Laucks et al. | 115/35 |
| 4,225,286 | 9/1980 | Fork | 416/4 |
| 4,247,251 | 1/1981 | Wuenscher | 416/24 |
| 5,462,406 | 10/1995 | Ridgewell et al. | 416/111 |
| 5,993,157 | 11/1999 | Perfahl | 416/111 |

OTHER PUBLICATIONS

Article Voith–Schneider–Propeller der intelligente Schiffsantrieb, Pub. No. 2801, 1994.

Article Die Konstruktion des heutigen Voith–Schneider–Propellers, Wolfgang Baer, 1967.

*Primary Examiner*—Edward K. Look
*Assistant Examiner*—Ninh Nguyen
*Attorney, Agent, or Firm*—Taylor & Aust, P.C.

[57] ABSTRACT

A cycloidal propeller including a so-called slider-crank mechanism. The couplers of the slider-crank mechanism are attached to a control ring which is attached to a ball socket located at the lower end of a control rod. The required torsional retention relative to the rotor housing is accomplished by a dual parallel guide, which is mounted by revolute joint connections to the control ring on one side and by revolute joint connections to the rotor housing on the other side.

9 Claims, 3 Drawing Sheets

CYCLOIDAL PROPELLER

BACKGROUND OF THE INVENTION

1. Field of the Invention.

The present invention relates to a cycloidal propeller.

2. Description of the Related Art.

A known cycloidal propeller is described in Voith special publication 1803 entitled "The design of today's Voith-Schneider Propeller", (special publication by Voith "Research and Design", book no.18, page 3, May 1967), as well as Voith Druck 9.94 2000.

Slider-crank mechanisms have been successfully applied on blade activation linkages having a maximum of five blades. A larger number of blades causes interference between the mounting locations. Slider-crank mechanisms have the advantage relative to other kinematic mechanisms of having revolute joint connections only. Propellers having more than five blades offer significant benefits as the power absorption of the propeller increases.

SUMMARY OF THE INVENTION

The present inventions provides a blade activation mechanism which is capable of utilizing revolute joint connections on propellers with more than five blades while avoiding the interference problem between the mounting locations as they pertain to the revolute joint connections in the area of the control rod.

The control ring permits—from a design perspective—a relatively simple mounting of the blade activation linkage couplers onto the ball socket of the control rod. Furthermore, the construction of the parallel guides as two halves, each respective half having one joint rod with each rod extending in the opposite direction with respect to the parallel guides, offers the capability—due to the length ratios of the joint rods—to affect the blade angle curvature in a certain way, and thus the hydrodynamic characteristic of the propeller. This feature can be applied to propellers with any number of blades.

The propeller blades are linked to the control ring. Therefore, the respective control arms of the slider-crank mechanism can reside in one plane rather than residing, as is the case with current designs, in different planes. This permits the control arms, as well as the blades, to be designed identically. The linkage of the parallel guides includes only rotational type bearings which tend to wear relatively little and are less demanding with respect to maintenance as compared to sliding friction bearings.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
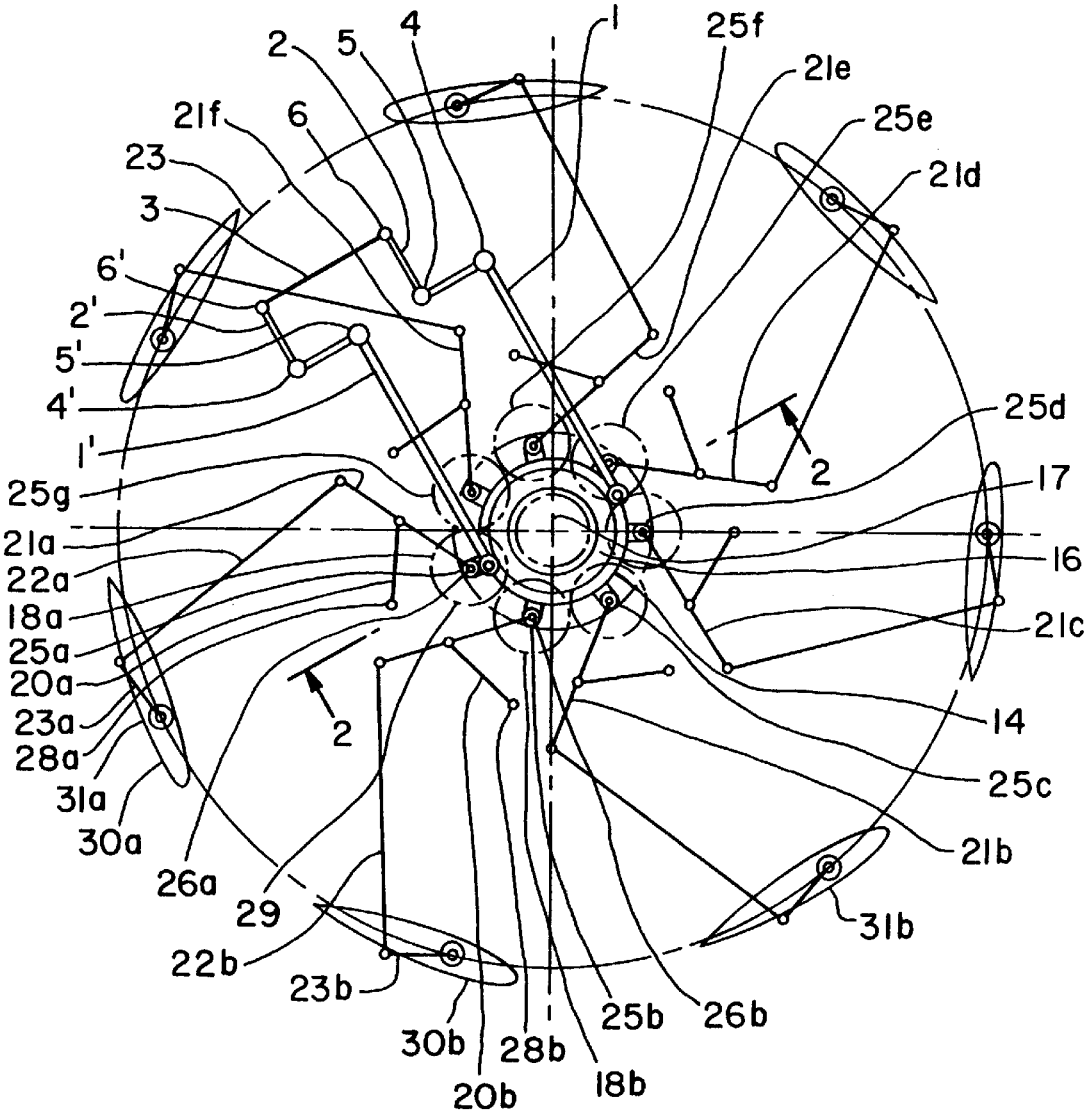
FIG. 1 is a top view of one embodiment of a cycloidal propeller of the present invention.

FIG. 1 displays the propeller blades 30*a*, 30*b* etc., equally distributed on blade circle 23. Each blade activation linkage assembly includes tie rod 20*a*, 20*b*, etc., coupler 21*a*, 21*b*, etc., and connecting rod 22*a*, 22*b*, etc., attached to activation lever 23*a*, 23*b*, etc, which, in turn, is connected to propeller shaft 31*a*, 31*b*, etc., of blade 30*a*, 30*b*, etc. Each blade activation linkage assembly is attached to control ring 14. Coupler 21*a*, 21*b*, etc., is connected to revolute joint connection 26*a*, 26*b*, etc., which is mounted on extension 25*a*, 25*b*, etc.

Figure 2:
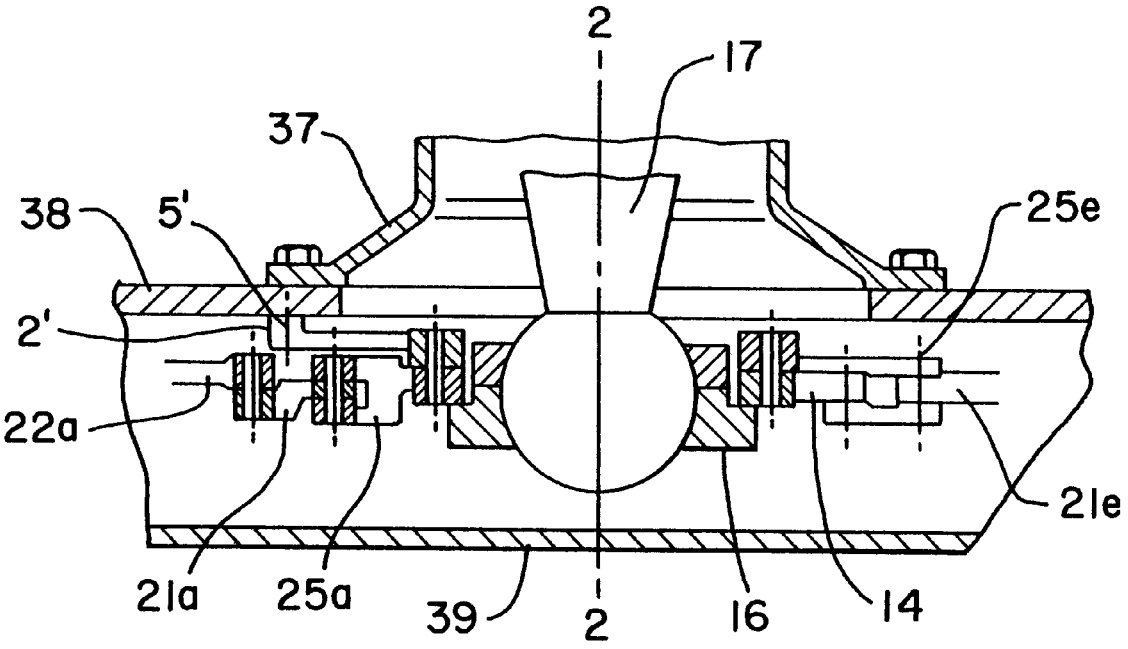
FIG. 2 is a side sectional view along line 2—2 of the cycloidal propeller of FIG. 1.

It is evident from FIG. 2 that control ring 14 is mounted to ball socket 16 on the lower end of control rod 17. The revolute joint connection 28*a* of tie rod 20*a* is positioned on the loose tie rod 20*a*—with respect to the blade activation linkage—and is attached above the linkage to cover plate 38 of rotor housing 39. The outer part of rotor housing 39 is not shown in FIG. 2. Each blade activation linkage assembly, especially couplers 21*a*, 21*b*, etc., are positioned on the same plane. This has the benefit of avoiding any bending moments acting on control rod 17.

FIG. 2 also illustrates part of the drive reel 37 of rotor housing 39 extending upward toward the area that holds the thrust plate (not shown) and finally connecting to the ring gear (not shown) of the drive transmission (not shown) of the propeller drive. Revolute joint connection 5' of the parallel guide assembly having guide rods 1, 2 and 1', 2' and connecting rod 3 is anchored at cover plate 38 of rotor housing 39.

Figure 3:
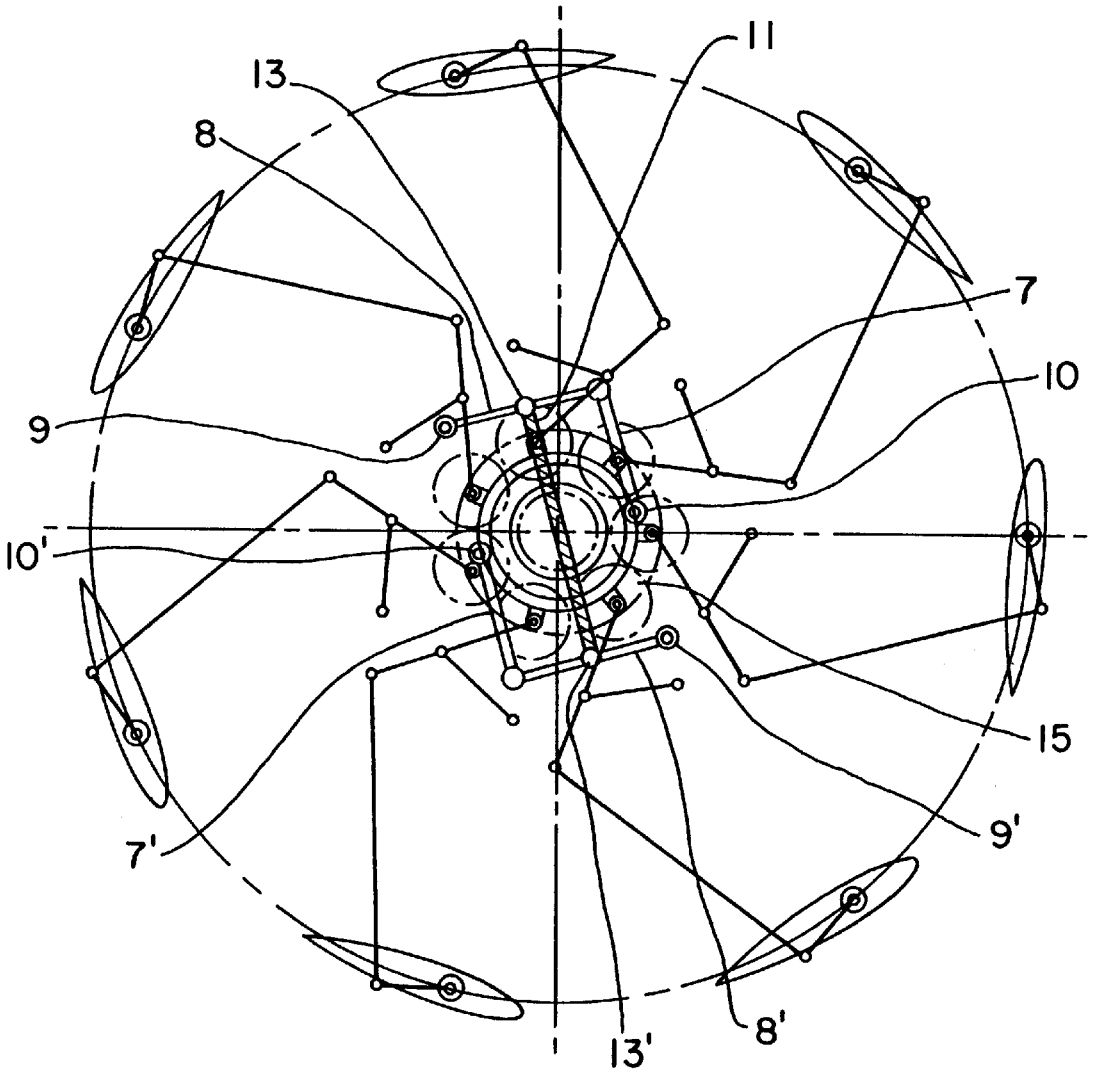
FIG. 3 is a top view of a second embodiment of a cycloidal propeller of the present invention.

FIG. 3 illustrates a second embodiment of a cycloidal propeller of the present invention. The parallel guide assembly includes individual rod sections 7, 8, 7', 8' and revolute joint connections 9 and 9' which are attached to rotor housing 39. Connecting rod 11 of the two halves of the parallel guide is connected to diametrically opposed sections 8 and 8' by revolute joint connections 13 and 13'. Connecting rod 11 is positioned below control rod 17 and ball socket 16.

Connecting rod 11 can be alternatively configured to encompass control rod 17 or ball socket 16 in a hoop-like fashion. Alternatively, a hoop-like and V-shaped connecting rod 11 can be placed underneath rotor housing 39. This design promotes a reduction in the distortion of the blade angle curvature. This effect can also be used to influence the blade angle curvature in a desired direction, through clever selection of the length relationships of the parallel joint rods. To this extent, the "displaced" slider-crank mechanism may provide a special advantage for applications using a smaller number of blades.

Small circles 18*a*, 18*b*, etc, shown in dot-and-dash pattern in FIG. 1 indicate the range in movement of revolute joint connections 26*a*, 26*b*, etc, attached to control ring 14 when displacing control rod 17 (adjustment of the eccentricity).

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A cycloidal propeller, comprising:

a control ring;

a control rod disposed at least partially within said control ring, said control rod configured for acting upon and adjusting said control ring;

a plurality of blade activation linkage assemblies, each of said blade activation linkage assemblies including a plurality of rod elements, one of said rod elements within each of said blade activation linkage assemblies defining a respective coupler;

a plurality of revolute joint connections, said revolute joint connections interconnecting each of said rod elements within each of said blade activation linkage assemblies, a respective one of said plurality of revolute joint connections interconnecting each said respective coupler within each of said blade activation linkage assemblies to said control ring;

a rotor housing; and at least one parallel guide assembly connected to and configured for torsionally retaining said control ring relative to said rotor housing.

2. The cycloidal propeller of claim 1, wherein said control rod has a lower end defining a ball socket, said ball socket being disposed within said control ring.

3. The cycloidal propeller of claim 1, wherein said at least one parallel guide assembly has a first end and a second end, a respective one of said revolute joint connections interconnects said first end of said at least one parallel guide assembly to said control ring and another respective one of said revolute joint connections interconnects said second end of said at least one parallel guide assembly to said rotor housing.

4. The cycloidal propeller of claim 1, wherein said at least one parallel guide assembly includes a first guide rod and a second guide rod, a respective said revolute joint connection interconnecting each of said first guide rod and said second guide rod to diametrically opposed points on said control ring, each said first guide rod and said second guide rod extending in the same direction and being substantially parallel relative to each other.

5. The cycloidal propeller of claim 1, wherein said at least one parallel guide assembly comprises a first parallel guide assembly and a second parallel guide assembly said first parallel guide assembly and said second parallel guide assembly each having a respective first guide rod and a respective second guide rod, each said first guide rod being interconnected with a corresponding said second guide rod such that each said first guide rod is substantially perpendicular to a corresponding said second guide rod, said first guide rod of said first parallel guide assembly and said first guide rod of said second parallel guide assembly being interconnected to said control ring at diametrically opposed points by a respective revolute joint connection and extending in opposite directions therefrom such that said first guide rod of said first parallel guide assembly is parallel with said first guide rod of said second parallel guide assembly, a respective revolute joint connection interconnecting each respective said second parallel guide rod to said rotor housing.

6. The cycloidal propeller of claim 5, further comprising a connecting rod interconnecting said second guide rod of said first parallel guide assembly and said second guide rod of said second parallel guide assembly.

7. The cycloidal propeller of claim 6, wherein said connecting rod is substantially perpendicular to each said second guide rod.

8. A cycloidal propeller, comprising:

a plurality of propellers;

a control ring;

a control rod disposed at least partially within said control ring, said control rod configured for acting upon and adjusting said control ring; and a plurality of blade activation linkage assemblies, each of said blade activation linkage assemblies including a plurality of revolute joint connections, a coupler having a first end and a second end, a tie rod having a first end and a second end, a connecting rod having a first end and a second end, and an activation lever having a first end and a second end, each said first end of each respective said tie rod being interconnected by a respective one of said revolute joint connections to a respective said coupler at a point between said first end of said respective coupler and said second end of said respective coupler, each said second end of each respective said coupler being interconnected by a respective one of said revolute joint connections to said first end of a respective said connecting rod, each said second end of each respective said connecting rod being interconnected by a respective one of said revolute joint connections to each said first end of a respective said activation lever, each said second end of each respective said activation lever being interconnected by a respective one of said revolute joint connections to a respective said propeller, and each said first end of each respective said coupler being interconnected by a respective one of said revolute joint connections to said control ring.

9. The cycloidal propeller of claim 1, wherein said control ring includes an extension corresponding to each of said blade activation linkage assemblies, each said extension having a first end and a second end, each said first end of each said extension being connected to said control ring, each said second end of each said extension being interconnected by a respective one of said revolute joint connections to a respective said coupler, thereby interconnecting each of said blade activation linkage assemblies to said control ring.

* * * * *